US006217200B1

(12) United States Patent
Huffman

(10) Patent No.: US 6,217,200 B1
(45) Date of Patent: Apr. 17, 2001

(54) DETACHABLY MOUNTABLE SAFETY LIGHT APPARATUS FOR A TRAILERED BOAT

(76) Inventor: Jared D. Huffman, 194 Hwy. 310, Waterford, MS (US) 38685

( * ) Notice: Subject to any disclaimer, the term of this patent is extended or adjusted under 35 U.S.C. 154(b) by 0 days.

(21) Appl. No.: 09/429,916

(22) Filed: Oct. 29, 1999

(51) Int. Cl.[7] ..... B63B 45/00

(52) U.S. Cl. ..... 362/477; 362/276; 362/396; 362/376; 362/485; 416/146 R; 340/431; 340/474

(58) Field of Search ..... 362/477, 485, 362/253, 396, 276, 376, 542; 416/146 R; 440/49; 340/431, 474

(56) References Cited

U.S. PATENT DOCUMENTS

| | | | | |
|---|---|---|---|---|
| 3,870,875 | | 3/1975 | Altimus | 240/2 R |
| 5,157,591 | | 10/1992 | Chudzik | 362/80 |
| 5,273,399 | | 12/1993 | Ojeda | 416/146 R |
| 5,613,886 | | 3/1997 | Cribbs | 440/2 |
| 5,664,975 | | 9/1997 | Carlisle | 440/49 |
| 5,725,228 | | 3/1998 | Livingston | 280/414.1 |
| 5,980,073 | * | 11/1999 | Whipple | 362/485 |

* cited by examiner

*Primary Examiner*—Stephen Husar
(74) *Attorney, Agent, or Firm*—Oliff & Berridge, PLC

(57) ABSTRACT

A safety light apparatus is provided for a trailered boat including an inboard or outboard propellered motor. The apparatus designed to be detachably mountable on a hub of the propellered motor. The apparatus preferably comprises a housing with a mounting recess, which is adapted to receive the hub, formed in a rear side thereof and a light assembly disposed on a front side of the housing. The light assembly preferably comprises a tail/brake light, which may include a back-up light, and an electrical connection assembly for electrically connecting the light assembly to a vehicle towing the trailered boat. The tail/brake light may be arranged to emit light pulses in response to application of the brake pedal of the vehicle. The safety light assembly may also comprise a back-up sensor installed on the housing which emits a warning signal upon detection of an obstruction. Preferably, the warning signal has an intensity which is dependent upon the distance between the obstruction and the back-up sensor. The apparatus also includes a securing mechanism which holds the housing relative to the hub. In one embodiment, the securing mechanism comprises a cable, adapted to encircle at least a part of the propellered motor and connected at one end to the housing, and a latch connected to the other end of the cable and pivotably connected to the housing and arranged to tighten the cable relative to the housing. The latch may include a portion which is adapted to receive a lock.

18 Claims, 3 Drawing Sheets

DETACHABLY MOUNTABLE SAFETY LIGHT APPARATUS FOR A TRAILERED BOAT

BACKGROUND OF THE INVENTION

1. Field of the Invention

The present invention relates to a safety light apparatus which is detachably mountable on a trailered boat. More particularly, the present invention relates to a safety light apparatus which is designed to be mounted on a hub of a propellered motor of the trailered boat.

2. Description of the Prior Art

Personal boats in general are transported over land using trailers which are towed by a motor vehicle. Such trailers generally include rear safety lights, which are electrically connected to the rear lights of the towing vehicle, since trailered boat at least partially, if not totally, obstructs the rear lights of the towing vehicle from the view of following traffic. However, trailers in general are designed to be low-riding, thus providing a low center of gravity for the trailered boat to improve the handling of the trailer and to avoid undue risk of roll-over.

Trailers in general are also designed with a boat supporting structure that allows easy loading of the boat from the rear. This, however, requires that the rear safety lights of the trailer must be mounted at or below the supporting structure so as to avoid interference with loading/unloading of the boat and damage to the rear safety lights or the boat. Typically, the rear safety lights are mounted on each side of the supporting structure, but are still restricted in height since the boat itself is typically wider than the supporting structure of the trailer.

Therefore, the rear safety lights of the trailer are mounted in a relatively low position which is substantially lower than the normal line of sight for most passenger vehicles, and even far lower still than the normal line of sight for larger vehicles such as semi-tractor trailers, busses and some Sport Utility Vehicles (SUVs). This imposes a great risk of property damage and personal injury from a failure of following traffic to notice the rear safety lights of the trailer.

The value of rear safety lights which are mounted in a higher position so as to be in the normal line of sight of most vehicles has been recognized for years. Almost all newer vehicles include auxiliary or "third" brake lights which are mounted above the traditional brake lights. However, even such auxiliary brake lights are typically obscured from view by a trailered boat. Thus, there is a need to improve the safety of trailered boats to prevent unnecessary property damage and personal injury.

This need has been recognized by others. For example, U.S. Pat. No. 5,725,228 discloses a watercraft which has rear lights incorporated into the rear end thereof which are electrically connected to the brake light system of the towing vehicle. This approach, however, is rather expensive in that it requires the purchase of a new boat with the rear lights installed or the permanent modification of an existing boat to install the rear lights.

Furthermore, this approach is particularly adapted for use with boats having an inboard motor wherein the entirety of the motor structure is installed within the hull of the boat and the propeller is connected at the bottom of the hull. It is not suitable, however, for use with boats having an outboard motor, wherein the entirety of the motor is installed on the rear of the boat extending therefrom, since the additional brake light provided would itself be obscured by the motor housing. Even if the brake light were positioned so as to be visible past the motor housing, the brake light would not be positioned at the rearmost portion of the boat, since the motor extends beyond the boat itself, which does not provide an ideal warning for following vehicles.

U.S. Pat. No. 5,157,591 provides a detachably mountable auxiliary vehicle lighting system which is readily mounted in many situations. However, the system is not particularly well suited for a trailered boat as it is to be mounted below the supporting structure, thus yielding no particular advantage over the known rear safety lights for trailers. Furthermore, as noted above, the mounting of this system is not ideal since the boat itself typically extends beyond the end of the trailer. In particular, with boats having an outboard motor or an inboard outboard motor, wherein the engine structure is mounted within the hull of the boat and part of the motor extends from the rear of the hull, the motor extends even further beyond the trailer.

U.S. Pat. Nos. 3,870,875 and 5,613,886 provide safety lights that are particularly designed for trailered boats. The 875 patent teaches a cover which is only designed to fit over the part of an inboard outboard motor that extends from the hull of a trailered boat. The cover has an electric tail light mounted near its rear. This cover, however, has many drawbacks. In particular, it is not adapted for use on an inboard motor or an outboard motor and still does not place the safety light at the rearmost portion of the trailered boat since a portion of the motor extends rearward of the light. Additionally, the cover is somewhat cumbersome to use/remove and the light itself is not securely supported by any structure other than the flexible cover.

The 886 patent teaches a safety light apparatus which is permanently affixed to an outside housing of an outboard motor. While the safety light apparatus indeed provides a rear safety light that is mounted higher and is more readily visible to traffic following the boat when trailered, the apparatus entails other drawbacks. In particular, since the apparatus is permanently mounted to the motor, the expenses of modifying an existing motor to install such an apparatus or purchasing a new motor with such an apparatus already installed are encountered. Further, the apparatus is not adapted for use on an inboard motor or an inboard outboard motor and still does not place the safety light at the rearmost portion of the trailered boat since again the lower portion of the motor including the propeller extend rearward of the apparatus.

In as much as the brake lights of a towing vehicle are obscured by a trailered boat, the back-up lights of the towing vehicle are typically even more obscured. Therefore, a need also exists for auxiliary back-up lights for trailered boats to indicate backing-up of the towing vehicle and trailered boat. It is also noted that it is difficult to judge the distance between the rear of the trailered boat and obstructions when backing-up, particularly at night. Thus, enhancement of the driver's vision and judgment would be beneficial.

SUMMARY OF THE INVENTION

The present invention aims to provide a safety light apparatus for a trailered boat which is convenient to use, relatively inexpensive, adapted for use with boats equipped with either outboard motors, inboard motors or inboard outboard motors, easily adaptable to fit motors of different sizes and shapes, securely mountable to maintain proper positioning, lockable to prevent theft and mountable in an ideal location for safety.

To achieve the foregoing objectives, the present invention provides a safety light apparatus which is designed to be detachably mountable on a hub of a propellered motor.

The apparatus preferably comprises a housing with a mounting recess formed in a rear side thereof and a light assembly disposed on a front side thereof. The mounting recess is adapted to receive a hub of a propellered motor such that the apparatus is mountable thereon.

According to a preferred embodiment, the light assembly has a primary direction of radiance which is substantially horizontal in use, that is, when the apparatus is mounted on the hub of a trailered boat. The mounting recess is formed such that a central axis thereof is axially offset with respect to the substantially horizontal primary direction of radiance when the apparatus is mounted on the hub of a trailered boat.

In yet another preferred embodiment, at least one bushing is arranged within the mounting recess such that the mounting recess is adapted to receive different sized hubs.

The light assembly in particular may comprise a tail/brake light or a back-up light. It preferably includes an electrical connection assembly for electrically connecting the light assembly to a vehicle towing the trailered boat. In addition to providing a back-up light, the apparatus may include a back-up sensor.

The apparatus also includes a securing mechanism which holds the housing relative to the hub. In one embodiment, the securing mechanism comprises a cable, adapted to encircle at least a part of the propeller or the propellered motor, and a buckle or latch connected to the housing and arranged to tighten the cable relative thereto. Additionally, the latch or buckle may include a portion which is adapted to receive a lock.

Other features and advantages of the present invention are described hereinafter.

BRIEF DESCRIPTION OF THE DRAWINGS

Further details of the present invention will be better understood from the following detailed description of the preferred embodiments, with reference to the accompanying drawings, in which.

DETAILED DESCRIPTION OF THE PREFERRED EMBODIMENTS

Figure 1:
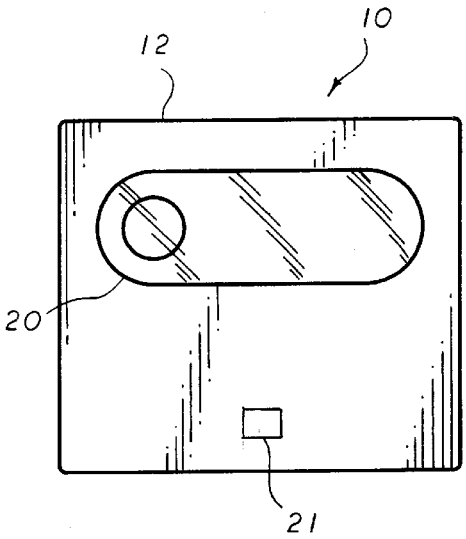
FIG. 1 shows a front view of a preferred embodiment of the safety light apparatus according to the present invention.

As shown in FIGS. 1–4, a preferred embodiment of a detachably mountable safety light apparatus 10 according to the present invention mainly comprises a molded plastic housing 12 which presents a front side 14 on which a light assembly 20 is disposed. It will be appreciated that the shape and dimensions of both the housing 12 and the light assembly 20 may be varied in accordance with any desired configuration as long as the light assembly 20 is properly positioned once the safety light apparatus 10 is mounted. By properly positioned, it is meant that the safety light apparatus 10 mounted such that the light assembly is highly visible for traffic following behind, and preferably peripherally, the trailered boat being towed.

The light assembly preferably comprises a tail/brake light and an electrical connection assembly which is adapted to electrically connect the light assembly to a tail/brake light system of a towing vehicle. The light assembly may include an electrical circuit which is arranged to cause the tail/brake light to emit light pulses in response to application of a brake pedal by a driver of the towing vehicle.

The light assembly may also comprise a back-up light which is electrically connected to a back-up light system of a towing vehicle, preferably by its own electrical connection assembly. The back-up light may be designed to not only provide an indication of the vehicle being backed-up, but also to provide substantial illumination to assist a driver by enhancing his vision and judgment. The back-up light may be combined with the tail/brake light or may be separately positioned on the front side 14 of the housing 12.

Furthermore, the safety light apparatus may include a backing sensor 21 installed on the housing 12. The backing sensor 21 is preferably arranged to emit a warning upon detection of an obstacle or obstruction within a predetermined proximate zone thereof. Preferably, the signal emitted has an intensity which is dependent upon the distance between the obstruction and the backing sensor 21, ideally such that the intensity of the signal increases geometrically as the distance decreases. The sensor 21 is preferably acoustic, although an optical sensor may be used as well.

Figure 2:
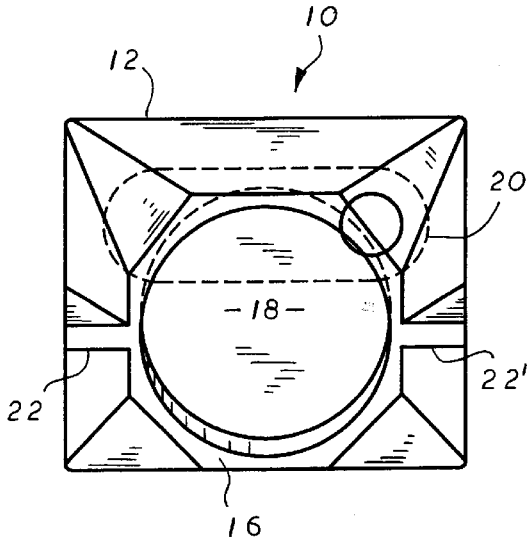
FIG. 2 shows a rear view of the embodiment shown in FIG. 1.

FIG. 2 shows a rear view of the preferred embodiment of the safety light apparatus 10. The housing 12 has been mounting recess 18 formed in a rear side 16 thereof. The mounting recess 18 is shown as a generally circular cavity which is axially offset with respect to a plane 20' of the light assembly 20. This is readily seen in the side view of Figure. As such, a central axis 18' forms an angle a with respect to a primary direction of radiance 20" of the light assembly 20. The purpose of having the mounting recess 18 axially offset with respect to the plane 20' of the light assembly 20 will be explained further herein.

Figure 3:
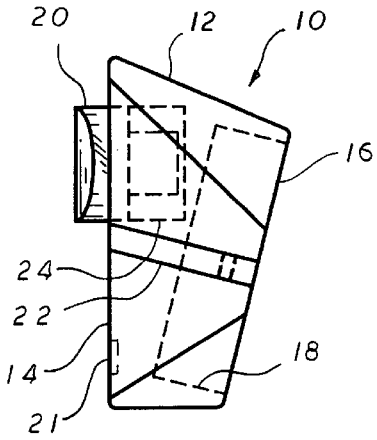
FIG. 3 shows a side view of the embodiment shown in FIG. 1.
Figure 4:
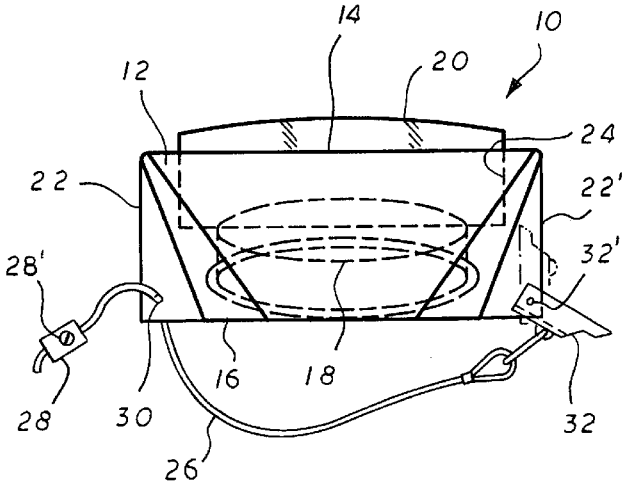
FIG. 4 shows a top view of the embodiment shown in FIG. 1.

The rear side 16 of the housing 12 is formed with two lateral abutments or projections 22, 22' as shown in FIGS. 2–4. The abutments 22, 22' are also axially offset with respect to a plane 20' of the light assembly 20 so as to extend parallel to the central axis 18' of the mounting recess 18.

As particularly shown in FIGS. 3 and 4, the housing 12 preferably has a light recess 24 formed in the front side 14 thereof. The light assembly 20 thus may be separately molded or assembled and then installed in the light recess 24 to comprise the safety light apparatus 10. Preferably, the light assembly 20 projects somewhat from the light recess 24 beyond the front side 14 of the housing 12. This enhances the peripheral visibility of the light assembly 20 for vehicles which are not directly behind the trailered boat being towed, for example in an adjacent lane of the road.

A securing mechanism comprising a cable 26 may be provided which is to used to secure the safety light apparatus 10 once it is mounted upon a hub of a propellered motor. The actual use of the cable 26 will be discussed later with reference to FIG. 5. The cable 26 preferably includes a cable stop 28 at one end which may include an adjustment screw 28' to adjust the position thereof along the cable 26 so as to provide a desired functional length. The other end of the cable 26 is preferably connected to a buckle or latch 32. The latch 32 is preferably one that is similar to one used on tool boxes or ski bindings which applies a tensioning force to latch the particular article. The adjustment screw 28' is preferably only adjustable by a specialized tool or is keyed so as to prevent easy theft of the safety light apparatus 10 once it is mounted upon a hub of a propellered motor. The cable 26 itself is preferably a braided metal cord which is difficult to sever and which may or may not be covered with a protective coating of rubber or hardened polymer.

Returning now to the purpose of the abutments 22, 22', one of the abutments 22 may be provided with a hole 30 through which the cable 26 is passed. After passing through the hole 30, one end of the cable 26 has the cable stop 28 secured thereto such that the cable 26 is movably secured to the housing 12 up to the point at which the prevented from cable stop 28 contacts the abutment 22. The other one of the abutments 22' then has the latch 32 pivotally mounted thereon via a pivot 32'. The other end of the cable 26 is connected to the latch 32.

Of course, other ways of securing mechanisms for the safety light apparatus 10 are within the scope of the present invention. For example, a relatively positionable, generally U-shaped bar or bracket (not shown) may be used. In such an embodiment, each end of the U-shaped bar connects to a respective one of the abutments 22, 22', with at least one of the ends having a connection that is adjustable so that the U-shaped bar may be properly positioned relative to the housing 12.

Figure 5:
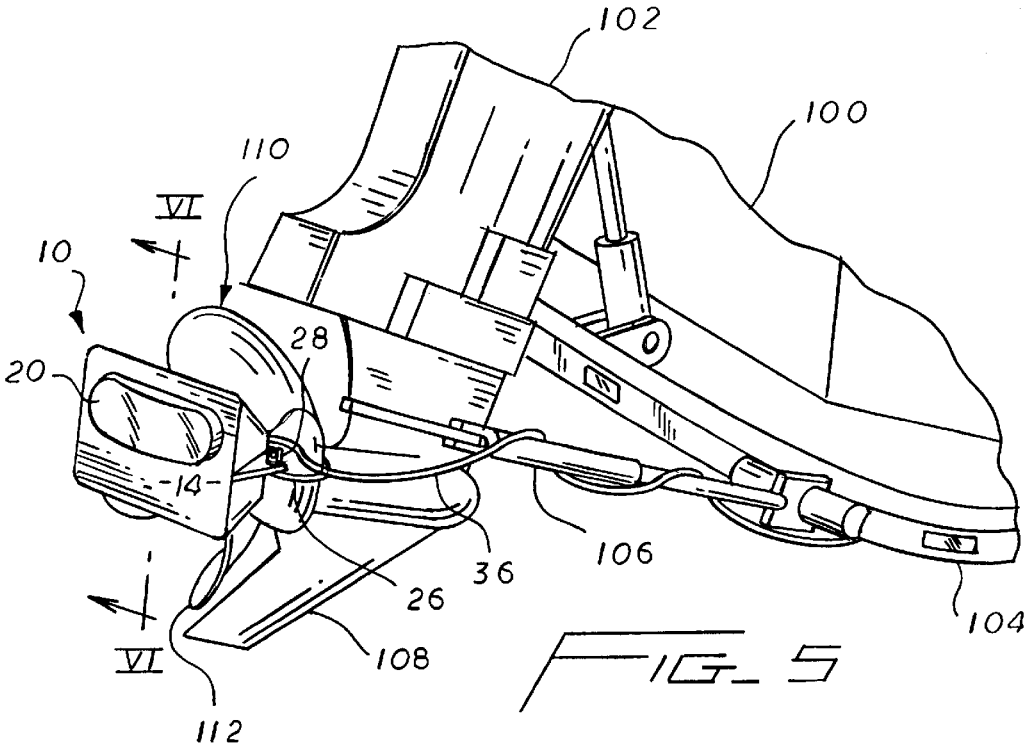
FIG. 5 shows a top right perspective view of an embodiment of the present invention installed upon the hub of an outboard motor of a trailered boat.

Referring now to FIG. 5, a boat 100 having an outboard propellered motor 102 is carried by a trailer 104. The propellered motor 102 itself is supported by a motor support 106 connected to the trailer 104. The motor support 106 supports the propellered motor 102 at an angle such that a lower end 108 thereof is raised to prevent it from contacting the ground when the trailered boat 100 is towed. Since the propellered motor 102 in its upright, in-use position typically extends below the bottom of the boat 100, the lower end 108 must be raised to provide necessary clearance for towing over bumps in the road or a change in road surface slope.

While a single outboard motor is shown, it will be understood that the safety light apparatus 10 according to the present invention may be installed on an inboard motor, an outboard motor, or an inboard outboard motor as well, or may be designed to mount upon a plurality of motors. This is because the safety light apparatus 10 according to the present invention is designed to be mounted upon a hub 110 of the propellered motor 102 behind the propeller blades 112 and is therefore not dependent upon the type of motor or the number or size of the propeller blades 112. It will also be understood that the safety light apparatus 10 according to the present invention is readily adapted to be mounted on motors of the jet-propulsion type which do not have propellers since they have an outlet which is similar in outer configuration to the hub of a propellered motor. In this sense, the term "hub" is considered encompass not only an actual hub of a propellered motor but also an outlet of a jet-propulsion type motor.

Figure 6:
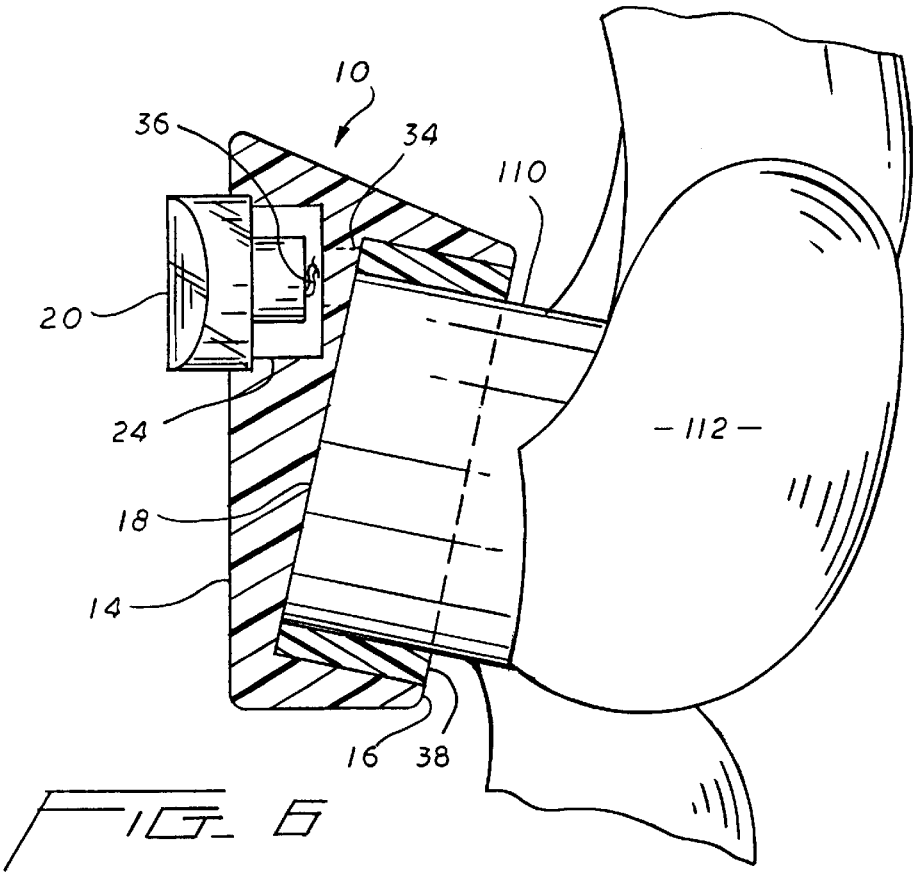
FIG. 6 shows a cross sectional view taken along line VI—VI wherein an embodiment of present invention is installed upon the hub using a bushing.

Referring to FIGS. 5 and 6, the safety light apparatus 10 is fitted onto the hub 110 of the propellered motor 102 behind the propeller blades 112. Once mounted, the safety light apparatus 10 is secured to the propellered motor 102 by looping the cable 26 around either at least two of the propeller blades 112 or the propellered motor 102. The position of the cable stop 28 is then adjusted to vary the functional length of the cable 26. Once the safety light apparatus 10 is mounted in the proper position upon the hub 110 of the propellered motor 102, the latch 32 is forced to rotate around its pivot 32' so as to tighten the cable 26 around the propeller blades 112 or the propellered motor 102 as the case may be. Once the latch 32 is fully rotated to contact the abutment 22', it may be secured to the housing with a conventional padlock (not shown) by passing the bar of the padlock through the latch and a portion of the housing 12. Since the cable stop adjustment screw 28' is keyed or may be turned only using a specialized tool, theft of the safety light apparatus 10 is substantially prevented.

As shown in FIG. 6, the housing 12 preferably includes an access hole 34 to the rear of the light recess 24 to accommodate wiring 36 of the light assembly 20. This wiring 36 and an appropriate connector may comprise the electrical connection assembly mentioned above. It is to be understood, of course, that the access hole 34 may be located anywhere convenient in the housing 12. In the preferred embodiment shown, the access hole 34 extends all the way to the 20 mounting recess 18 so that the wiring 36 emerges from the rear side 16 of the housing 12.

As shown in FIG. 6, the safety light apparatus 10 is mounted by on the hub 110 by fitting the hub 110 into the mounting recess 18 of the housing 12. A bushing 38 is shown disposed within the mounting recess 18 such that it fills any gap left between the hub 110 and the housing 12. One or more bushings 38, or none at all, may be used to adapt the safety light apparatus 10 for mounting on various sized hubs.

Figure 7:
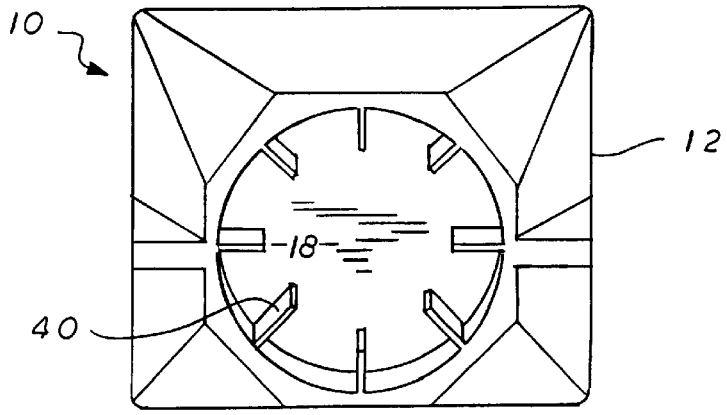
FIG. 7 shows a rear view of another embodiment of the present invention wherein the mounting recess includes a plurality of radial fins.

Of course, other ways of adapting the safety light apparatus 10 to mount on different sized hubs are within the scope of the present invention. For example, as shown in FIG. 7, the mounting recess 18 may have a plurality of relatively flexible or compressible fins 40 disposed around an inner circumference thereof. In use, the fins 40 are either radially compressed or flex to either side to accommodate different sized hubs. Preferably, the fins 40 are sufficiently resilient so that the safety light apparatus 10 may be mounted on a hub of one diameter and a hub of larger diameter without requiring further adaptation. The resiliency of the fins 40 may be such that they provide a gripping force against the hub 110. The fins need not be resilient, however, but rather may be made of the same material as the housing 12 and molded therewith. In such a case, the fins 40 would then be trimmed so as to fit the desired hub size.

The purpose of the axially offset of the mounting recess 18 and the abutments 22, 22' will now be made clear. As shown in FIGS. 5 and 6, when the boat 100 is mounted on the trailer 104, the propellered motor 102 is supported at an angle relative to the ground by the motor support 106. As noted above, this is necessary to raise the lower end 108 of the propellered motor 102 to prevent it from contacting the ground when the trailered boat 100 is towed over bumps or a change in road surface slope. This angle may vary somewhat depending on the particular propellered motor 102 and motor support 106; however, it does not vary too greatly. The axially offset of the mounting recess 18 compensates for the angle at which the propellered motor 102 is disposed when the boat 100 is trailered such that the primary direction of radiance 20" of the light assembly 20 is generally horizontal. Thus, the primary direction of radiance 20" of the light assembly 20 will be such that the maximum radiance of the light assembly 20 is directly behind the trailered boat 100 for maximum visibility.

Figure 8:
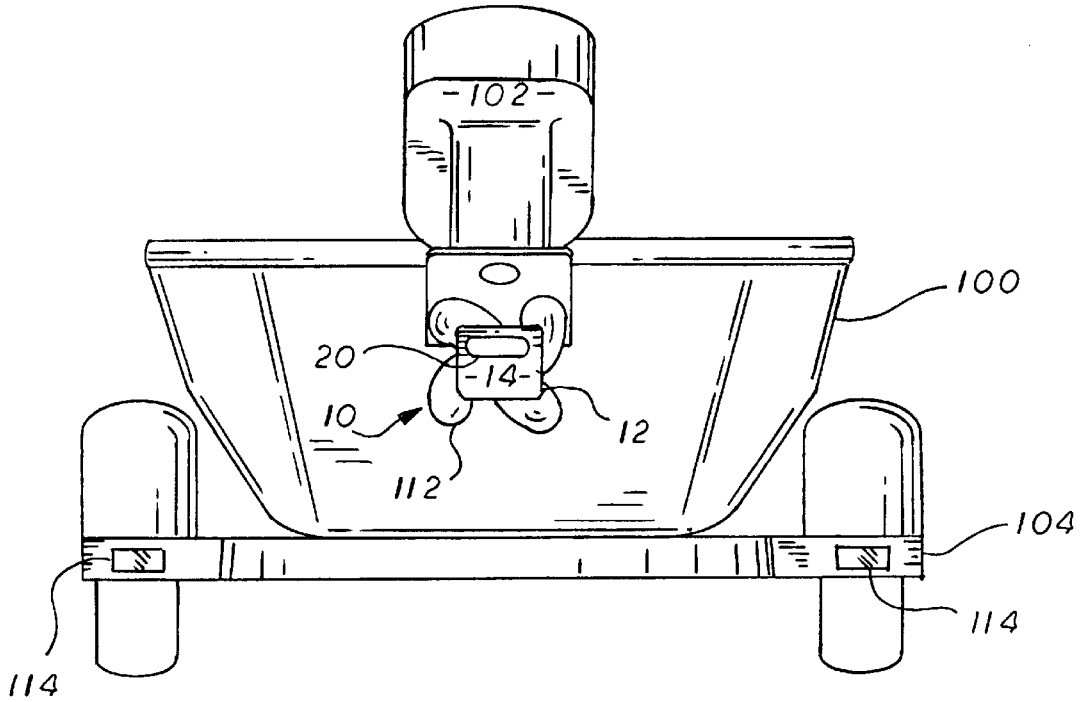
FIG. 8 shows a rear view of an embodiment of the present invention installed upon the hub of an outboard motor of a trailered boat.

As shown in FIG. 8, since the lower end 108 of the propellered motor 102 is raised, the safety light apparatus 10 according to the present invention is designed to be positioned at an ideal height, substantially in line with the line of sight of other vehicles. This height is significantly higher than that of conventional tail/brake lights 114 which are mounted on the trailer 104, typically on the rear side of the fenders thereof. Furthermore, as evident from FIG. 5, the safety light apparatus 10 according to the present invention is designed to be positioned at a rearmost point of the trailered boat 100 and propellered motor 102, an ideal position for safety which prevents the drivers of following vehicles from misjudging the distance between them and the trailered boat.

It is to be understood that the present invention is not limited in any way to the details of the preferred embodiments discussed above and illustrated in the accompanying drawings. Other embodiments including various modifications of the basic invention will be appreciated by those skilled in the art without departing from the spirit and scope of the present invention. Accordingly, the proper scope of the present invention should be determined only by the broadest permissible interpretation of the following claims.

What is claimed is:

1. A detachably mountable a safety light apparatus for a trailered boat including at least one motor, the apparatus comprising:

a housing having a front side and a rear side;

a mounting recess formed in the rear side of the housing, the mounting recess being adapted to receive a hub of a motor such that the apparatus is mountable thereon; and a light assembly disposed on the front side of the housing.

2. The safety light apparatus according to claim 1, wherein the light assembly has a primary direction of radiance which is substantially horizontal when the apparatus is mounted on a hub of a motor of a trailered boat; and wherein the mounting recess is formed such that a central axis thereof is axially offset with respect to the substantially horizontal primary direction of radiance when the apparatus is mounted on a hub of a motor a trailered boat.

3. The safety light apparatus according to claim 1, further comprising:

at least one bushing arranged within the mounting recess such that the mounting recess is adapted to receive different sized hubs.

4. The safety light apparatus according to claim 1, wherein the light assembly comprises:

a tail/brake light; and an electrical connection assembly which is adapted to electrically connect the tail/brake light assembly to a towing vehicle.

5. The safety light apparatus according to claim 4, wherein the light assembly further comprises:

a back-up light which is electrically connected to a back-up light system of a towing vehicle, the back-up light being arranged to provide an indication of backing-up and a substantial illumination to aid a driver's vision and judgment.

6. The safety light apparatus according to claim 4, wherein the tail/brake light is arranged to emit light pulses in response to application of a brake pedal of a towing vehicle.

7. The safety light apparatus according to claim 1, further comprising:

a back-up sensor installed on the housing and arranged to emit a warning signal to a driver of a vehicle towing a trailered boat upon detection of an obstruction within a predetermined proximate zone of the backing sensor; and an electrical connection assembly which is adapted to electrically couple the back-up sensor to the vehicle such that the back-up sensor is activated when the vehicle is put in reverse.

8. The safety light apparatus according to claim 7, wherein the warning signal emitted by the back-up sensor has an intensity which is dependent upon a distance between the obstruction and the back-up sensor.

9. The safety light apparatus according to claim 1, further comprising:

a securing mechanism which is adapted to hold the housing relative to a hub of a motor upon which the apparatus is to be mounted.

10. The safety light apparatus according to claim 9, wherein the securing mechanism comprises:

a cable connected at one end to the housing and adapted to encircle at least a part of the motor upon which the apparatus is to be mounted; and a latch connected to the other end of the cable and pivotably connected to the housing such that the latch is arranged to tighten the cable relative to the housing.

11. The safety light apparatus according to claim 10, wherein the latch includes a portion which is adapted to receive a lock.

12. The safety light apparatus according to claim 9, further comprising:

a pair of abutments formed integrally with the housing, the abutments being arranged to cooperate with the securing mechanism.

13. The safety light apparatus according to claim 12, wherein the securing mechanism comprises:

a cable connected at one end to the housing at a first one of the abutments and adapted to encircle at least a part of the motor upon which the apparatus is to be mounted; and a latch connected to the other end of the cable and pivotably connected to the housing at a second one of the abutments such that the latch is arranged to tighten the cable relative to the housing.

14. The safety light apparatus according to claim 13, further comprising:

a hole formed in the first one of the abutments through which the one end of the cable passes; and a cable stop connected to the one end of the cable passing through the hole.

15. The safety light apparatus according to claim 12, wherein the cable stop includes an adjustment screw for positioning the cable stop at a desired distance from the one end of the cable such that a functional length of the cable is properly set.

16. The safety light apparatus according to claim 1, further comprising:

a light recess formed in the front side of the housing, the light recess being arranged to receive the light assembly therein.

17. The safety light apparatus according to claim 12, wherein the light assembly projects from the light recess beyond the front side of the housing.

18. A detachably mountable a safety light apparatus for a trailered boat including at least one motor, the apparatus comprising:

a housing having a front side and a rear side;

a generally circular mounting recess formed in the rear side of the housing, the mounting recess being adapted to receive a part of a motor such that the apparatus is mountable thereon; and a light assembly disposed on the front side of the housing.

* * * * *